US005469347A

United States Patent [19]

Duve et al.

[11] Patent Number: 5,469,347

[45] Date of Patent: Nov. 21, 1995

[54] RETRO-FIT ILLUMINATED SIGN MODULE AND METHOD

[75] Inventors: George Duve, Washington, N.J.; Jeffrey S. Gieger, Dingmans Ferry, Pa.

[73] Assignee: Area Lighting Research, Inc., Hackettstown, N.J.

[21] Appl. No.: 192,701

[22] Filed: Feb. 7, 1994

[51] Int. Cl.[6] ..... F21V 5/00

[52] U.S. Cl. ..... 362/245; 362/183; 362/243; 362/800

[58] Field of Search ..... 362/183, 184, 362/241, 247, 800, 245, 243

[56] References Cited

U.S. PATENT DOCUMENTS

| | | | |
|---|---|---|---|
| 4,975,814 | 12/1990 | Schairer | 362/800 |
| 5,149,185 | 9/1992 | Mandy | 362/183 |
| 5,241,457 | 8/1993 | Sasajima et al. | 362/800 |
| 5,299,109 | 3/1994 | Grondal | 362/241 |
| 5,303,124 | 4/1994 | Wrobel | 362/800 |
| 5,365,145 | 11/1994 | Fields | 362/183 |

*Primary Examiner*—Carroll B. Dority
*Attorney, Agent, or Firm*—Kirschstein et al.

[57] ABSTRACT

A module for retro-fitting an illuminated Exit sign, includes a plurality of light emitting diodes mounted in the module. Light emitted by the diodes is reflected and scattered by a reflector panel in a generally uniform distribution pattern to illuminate the sign.

11 Claims, 3 Drawing Sheets

14
18
16
20
22
12
50
34
32
10
36
38
44
24
40
28
48
46
EXIT
26

3
18
22
20
16
EXIT
28
26
24
3

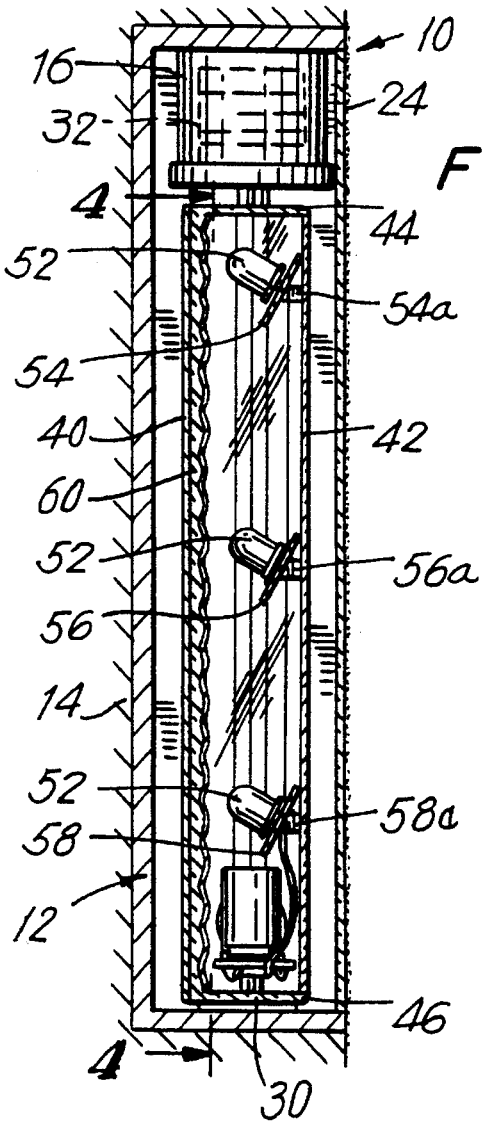
FIG. 3
FIG. 4
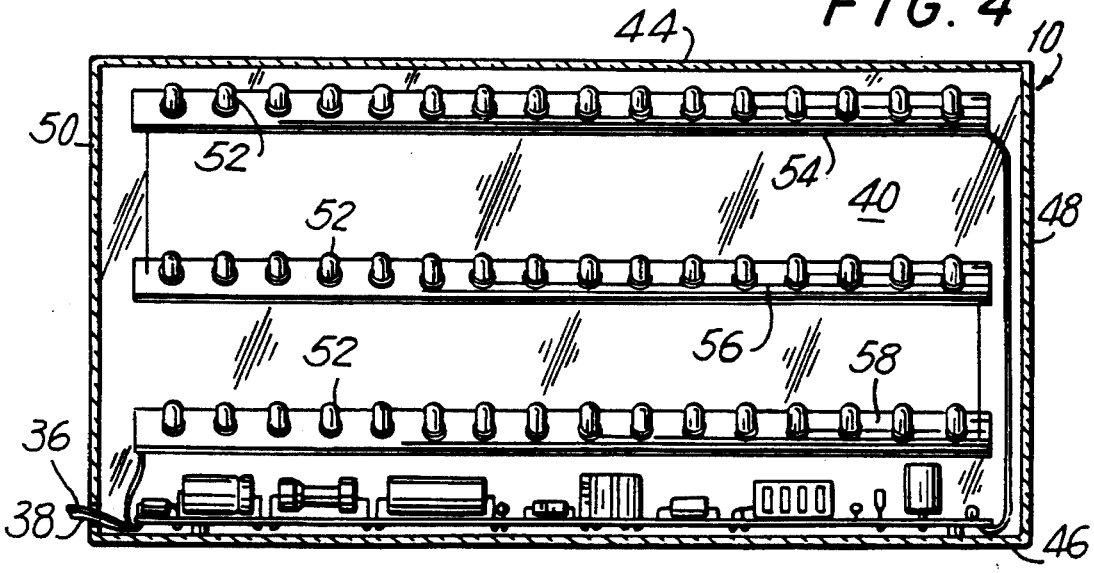

RETRO-FIT ILLUMINATED SIGN MODULE AND METHOD

BACKGROUND OF THE INVENTION

1. Field of the Invention

This invention generally relates to a module for, and a method of, retro-fitting an illuminated sign, such as an Exit sign.

Description of the Related Art

Exit signs in buildings are required by safety regulations to be illuminated at all times. Even in the event of a power failure, Exit signs are required to be illuminated at least ninety minutes after power has failed.

A typical Exit sign includes a receptacle mounted in a wall recess at an elevated position adjacent a stairwell. A metal or plastic cover plate having sequential cut-outs shaped in the letters E, X, I and T overlies and closes the receptacle. A red-colored, light-transmissive plate is typically positioned underneath the cover plate. Alternatively, an opaque plate having colored, light-transmissive letter-shaped areas could be used. A main power supply voltage (120 v/277 v AC, 60 Hz) is supplied to the receptacle, typically for energizing a pair of high wattage (40 w) incandescent lamps mounted in a pair of main lamp sockets in the receptacle. The light from both lamps passes through the red-colored plate and through the letter-shaped cut-outs or areas so that the word "EXIT" on the sign is prominently illuminated in red.

In the event of a power failure, back-up power is typically provided by a low voltage battery, e.g., 6 v DC, typically a rechargeable battery, together with a pair of low wattage incandescent lamps mounted in a pair of additional back-up lamp sockets in the receptacle. When main power is interrupted, the battery is connected to the low wattage lamps, thereby illuminating the sign for a limited period, usually ninety minutes, before the battery is drained.

Although generally satisfactory for their intended purpose, the known illuminated signs are disadvantageous in terms of energy efficiency and working lifetime. For example, the incandescent lamps eventually fail and have to be replaced, thereby requiring replacement bulbs and workers to effect the replacement in accordance with a maintenance schedule. Also, the lamps consume a comparatively large amount of electrical energy, if not individually, then certainly, in totality, when it is considered that many buildings have hundreds, if not thousands, of such illuminated signs. Moreover, since, at most, only two high wattage incandescent lamps are used during normal use or during a power failure, the sign is not uniformly illuminated. In other words, upon close inspection of the illuminated signs in current use, some zones of the letter-shaped cut-outs or areas are brighter than others depending upon their proximity to the lamps.

SUMMARY OF THE INVENTION

Objects of the Invention

It is a general object of this invention to provide a module for, and a method of, retro-fitting an illuminated sign.

Another object of this invention is to provide an energy-efficient, illuminated sign.

Still another object of this invention is to provide an illuminated sign having a long working lifetime.

Yet another object of this invention is to provide a highly reliable sign which is uniformly illuminated, not only in normal use, but also in the event of a power failure.

Features of the Invention

In keeping with these objects and others which will become apparent hereinafter, one feature of this invention resides, briefly stated, in a module for, and a method of, retro-fitting an illuminated sign, such as an Exit sign. The module comprises a housing having a back wall, a light-transmissive front wall overlying and spaced from the back wall, and side walls extending between the front and back walls. Preferably, all the housing walls are constituted of a transparent, synthetic plastic material.

The module further comprises a plurality of light sources, especially miniature, light emitting diodes, mounted in the housing on the front wall and facing rearwardly toward the back wall. The light sources are arranged in a plurality, preferably three, of longitudinally-extending rows spaced transversely apart of one another. The diodes are electrically connected in series, or in parallel, or in a series-parallel combination.

Means are provided for electrically energizing the light sources to emit light. Since the light emitting diodes require a DC source, means are provided for converting AC mains voltage provided at the sign to DC voltage.

Reflector means are provided on the back wall, for scattering the light emitted by all the energized light sources back toward and through the front wall in a generally uniform distribution pattern. Advantageously, the reflector means is constituted by a generally planar, reflector panel having an irregular, light-reflecting, textured surface. Preferably, the panel is mounted within the housing. The light sources are supported within the housing on a plurality of generally planar, support strips, one for each row. Each support strip is inclined relative to the reflector panel so that the light reflected by the panel passes uninterruptedly above and below the support strips through the front wall.

In the event of a power failure, a back-up power supply means is provided for converting a back-up low DC voltage at the sign to a higher DC voltage. Again, the light emitting diodes, together with the reflector panel, present a generally uniform distribution pattern to illuminate the sign.

Thus, in accordance with this invention, an energy-efficient sign having long working lifetime is provided. The light emitting diodes consume much less power and last for many more years than conventional incandescent lamps. The multitude of diodes, together with the rear-mounted reflector panel, eliminate dark zones or shadows on the sign.

In accordance with the method of this invention, all incandescent lamps within the receptacle are removed from their sockets. Thereupon, the module is mounted within the receptacle. An adhesive fastening strip is mounted on the housing in order to adhesively secure the housing in place within the receptacle.

An electrical connector is connected to one of the vacant main lamp sockets in order to electrically energize the light sources in the module. Another electrical connector is connected to one of the vacant back-up sockets. As before, light from the light sources is directed toward the reflector panel and back through the front wall in a generally uniform distribution pattern.

The novel features which are considered as characteristic of the invention are set forth in particular in the appended claims. The invention itself, however, both as to its construction and its method of operation, together with additional objects and advantages thereof, will be best understood form the following description of specific embodiments when read in connection with the accompanying drawings.

BRIEF DESCRIPTION OF THE DRAWINGS

FIG. 3 is an enlarged sectional view taken on line 3—3 of FIG. 2;

FIG. 4 is a sectional view taken on line 4—4 of FIG. 3; and

DETAILED DESCRIPTION OF THE PREFERRED EMBODIMENT

Figure 1:
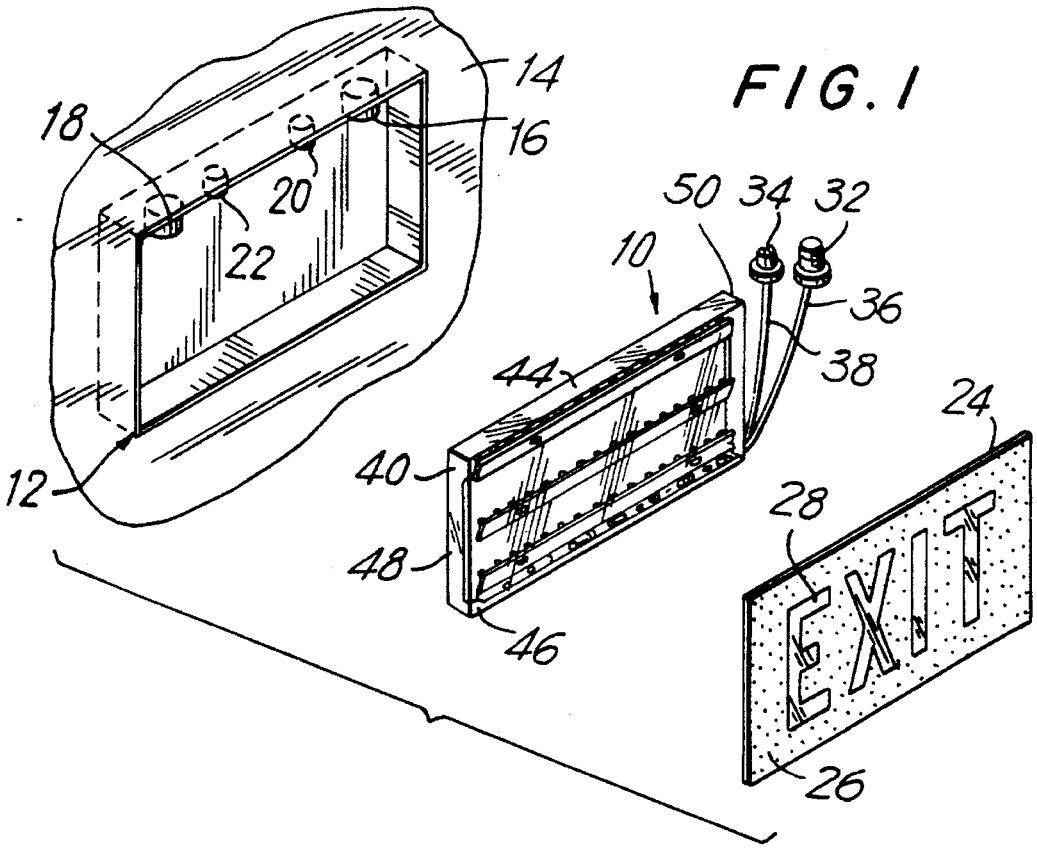
FIG. 1 is an exploded, perspective view of a module for retro-fitting an illuminated sign in accordance with the method of this invention.
Figure 2:
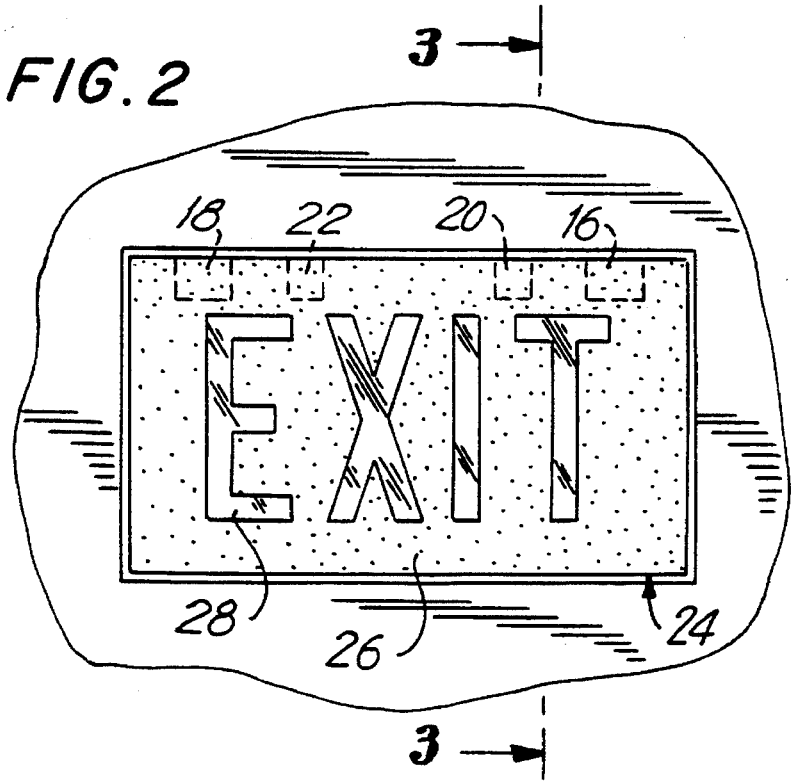
FIG. 2 is a front elevational view of the sign of FIG. 1 after assembly.

Referring now to the drawings, reference numeral 10 in FIG. 1 shows a module for retro-fitting an illuminated sign. The sign includes a receptacle 12 mounted within a recess in a wall 14 or a ceiling. A pair of spaced-apart, main lamp sockets 16, 18 for receiving high wattage (e.g., 40 w) incandescent lamps is mounted in the receptacle. A non-illustrated main power supply (120 v/277 v AC, 60 Hz) is supplied to the sockets 16, 18 in conventional manner to supply AC voltage to the lamps to energize them. Another pair of spaced-apart, back-up lamp sockets 20, 22 for receiving low wattage (e.g., 6 w) incandescent lamps is also mounted in the receptacle. A back-up power supply, e.g., a rechargeable battery (6 v DC) is connected to the back-up sockets 20, 22 to supply DC voltage to the low wattage lamps to energize them during a power failure for a limited time period. A cover plate 24 having light-blocking, opaque areas 26 and light-transmissive areas 28 overlies and closes the receptacle 12. The areas 28 are advantageously shaped as letters depicting a word and, in the illustrated case, the word "E X I T." This invention is not intended to be limited to illuminated Exit signs, but, as will be readily understood by people skilled in this art, can cover any alpha-numeric message, symbol, picture, or for that matter any information to be depicted on a sign, whether intended for buildings or otherwise.

As described so far, the sign is entirely conventional. The light emitted by the lamps in main sockets 16, 18 pass through the letter-shaped areas 28 at all times to constantly convey the message on the sign. In the event of a power failure, the back-up battery takes over to allow light emitted by the lamps in back-up sockets 20, 22 to pass through the letter-shaped areas 28 to convey the sign message.

In accordance with the method of this invention, all the incandescent bulbs in the sockets 16, 18, 20 and 22 are removed, and the module 10 is positioned securely within the receptacle. A double-sided, pressure-sensitive, adhesive fastener strip 30 (see FIG. 3) is mounted on the module and into engagement with an inner wall of the receptacle in order to hold the module in place. A main electrical connector 32 (see FIG. 1) is plugged or screwed into one of the vacant main lamp sockets 16 or 18 in order to supply AC power to the module at all times. A back-up electrical connector 34 is then screwed or plugged into one of the vacant back-up sockets 20 or 22 in order to supply back-up DC power to the module in the event of a power failure.

Module 10 includes a housing having a back wall 40, and a front wall 42 parallel to, and spaced apart from, the back wall along a depth direction. The module housing also includes a top wall 44, and a bottom wall 46 parallel to, and spaced apart from, the top wall 44 along a height direction. The module housing further includes a pair of side walls 48, 50 parallel to, and spaced apart from, each other along a longitudinal direction. All the housing walls are constituted of a transparent, synthetic plastic material, and essentially form a closed box with the electrical connectors 32, 34 extending by wires 36, 38 through a corner of the box.

A plurality of light sources, e.g., light emitting diodes 52, is mounted in the module on the front wall 42 and face the back wall 40. The diodes 52 are arranged in a plurality of rows, each row extending along the longitudinal direction, and the rows being spaced apart from one another along the height direction. As shown, there are three rows, each row containing sixteen diodes. All the diodes are electrically wired in a series, or parallel, or series-parallel, connection.

The diode rows are mounted on elongated, support strips 54, 56, 58 which are rigid, printed circuit boards. As best shown in FIG. 3, each strip 54, 56, 58 is inclined relative to the front and back walls of the module by respective support posts 54*a*, 56*a*, 58*a*. In turn, the diodes 52, which have an elongated bulb envelope, are inclined relative to the front and back walls and, as illustrated, they all point rearwardly and upwardly within the installed module.

A generally planar reflector panel 60 having an irregular, light-reflective, specular, textured surface is mounted on the back wall 40 and, in a modified construction, the panel 60 can itself constitute the back wall of the module. When the diodes 52 are energized, as described below, to emit light, the light from the diodes travels to the panel 60, then gets scattered, and next travels over and under the strips 54, 56, 58 toward and past the front wall to pass through the letter-shaped, light-transmissive areas 28, thereby illuminating the message on the sign. Since the light from the diodes 52 comes from multiple sources, and since the light is scattered by the reflector panel 60 in all directions, a generally uniform light distribution pattern is obtained for the illuminated sign.

Figure 5:
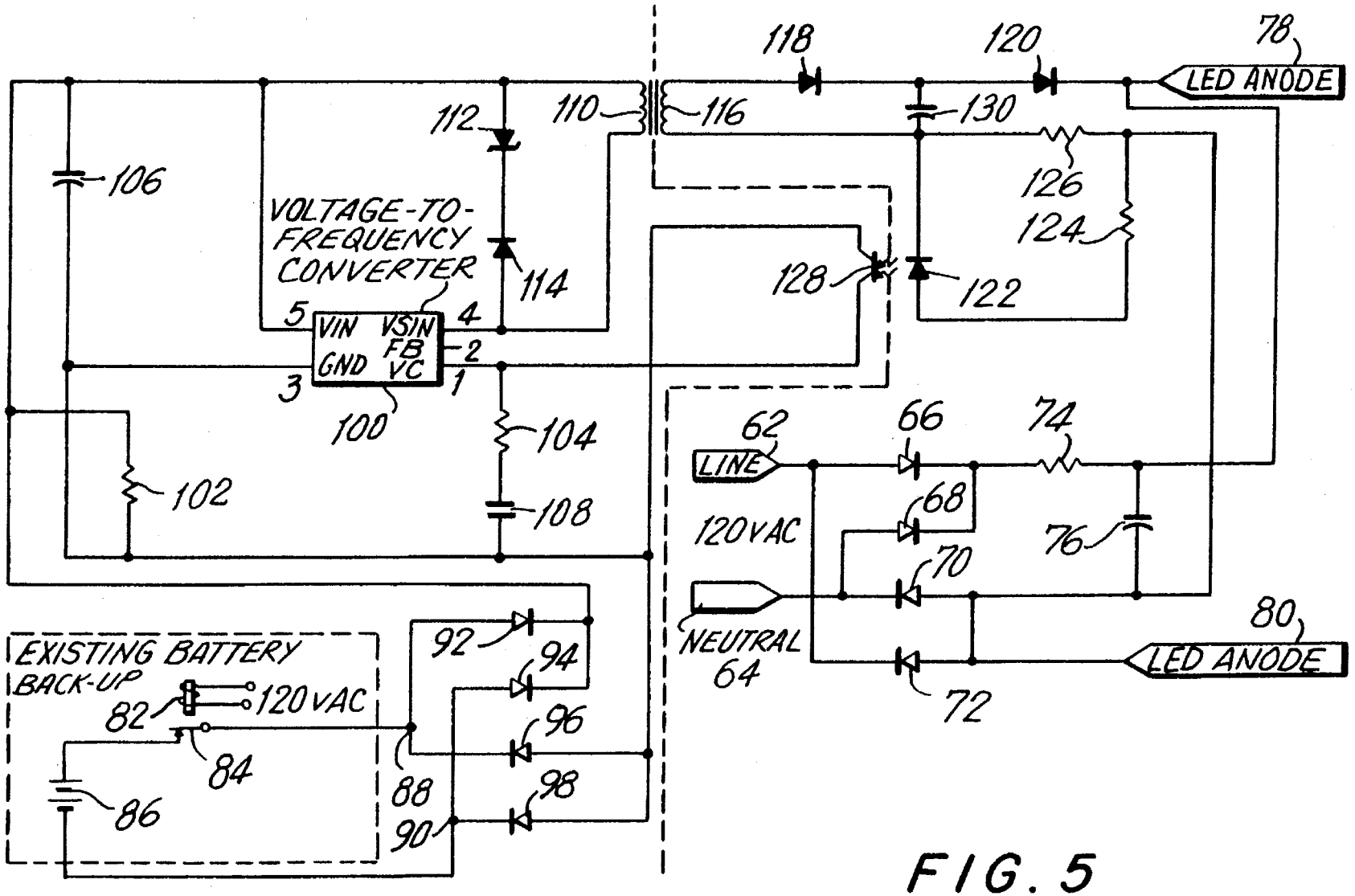
FIG. 5 is an electrical schematic of electrical circuitry within the module.

The electronic circuitry contained in the module for supplying main power, and for supplying back-up power, is shown in FIG. 5. The electrical connector 32, when plugged into vacant main lamp socket 16, supplies the 120 v AC at line and neutral terminals 62, 64. Rectifier diodes 66, 68, 70 and 72 convert the AC line voltage to DC voltage. Resistor 74 and capacitor 76 constitute a low pass filter. The rectified voltage is then fed to the anode 78 and cathode 80 terminals and, in turn, to all the series-connected diodes 52. Each diode 52 is a low wattage device and rated at about 2 v DC and, even when constantly energized, can last for over twenty years in a sign installation.

In the event of a power failure, a relay 82 is operative to close a switch 84, as illustrated in FIG. 5. This causes a rechargeable, back-up battery 86, typically 6 v DC, to be connected to the circuit. The relay 82, switch 84 and battery 86 are known in the art and are typically provided at the receptacle 12. The electrical connector 34, when plugged into vacant, back-up lamp socket 20, supplies the 6 v DC voltage at power terminals 88, 90.

In order to use this 6 v DC voltage to energize all the diodes 52, this invention proposes a full wave bridge rectifier consisting of diodes 92, 94, 96 and 98 in order to guarantee the polarity of the back-up battery voltage. This low DC voltage is conducted to a voltage-to-frequency converter 100 via resistors 102, 104 and capacitors 106, 108. The converter 100 is preferably an integrated circuit chip, Model No. LT 1070 CT operative for generating a radio frequency signal of about 100 kHz in the preferred embodiment. This radio frequency signal is fed to a primary coil 110 of a step-up transformer across which a clamping diode 112 and a diode 114 are connected. A higher voltage, e.g., 80 v, at the radio frequency of about 100 kHz, is output from a secondary coil 116 of the transformer. A rectifying diode 118 converts this high voltage to a DC voltage, now passing through diode 120 and having a sufficient magnitude to energize all the light emitting diodes 52.

The converter 100 requires a constant current source and, hence, light emitted from a light emitting diode 122 is detected by an opto-isolating regulator 128, thereby generating a constant current signal which is fed back in a feed-back loop to the converter 100. The anode of diode 122 is connected to a pair of voltage divider resistors 124, 126. The cathode of diode 122 is connected to a capacitor 130 which, in turn, is connected across the secondary coil 116 of the transformer. Thus, main power is delivered by terminals 62, 64 to the anode and cathode terminals 78, 80 of the rows of light emitting diodes 52 during normal operation and, in the case of a power failure, back-up DC power is converted from a low magnitude at terminals 88, 90 and conducted to the anode and cathode terminals 78, 80 of the diodes 52 at a higher DC voltage.

It will be understood that each of the elements described above, or two or more together, also may find a useful application in other types of constructions differing from the types described above.

While the invention has been illustrated and described as embodied in a retro-fit illuminated sign module and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

1. A module for retro-fitting an illuminated sign, comprising:

a) a housing having a generally planar back wall, a light-transmissive front wall overlying and spaced from the back wall, and side walls extending between the front and back walls;

b) a plurality of light sources mounted in the housing on the front wall and facing the back wall, said light sources being arranged in a plurality of longitudinally-extending rows spaced transversely apart of one another;

c) a plurality of generally planar support strips, one for each row, for supporting the light sources, each support strip being inclined relative to the generally planar back wall;

d) means for electrically energizing the light sources to emit light; and e) reflector means for reflecting the light emitted by the energized light sources away from the back wall and toward and through the front wall in a generally uniform distribution pattern.

2. The module according to claim 1, wherein the housing is constituted of a synthetic plastic material.

3. The module according to claim 1, wherein the housing is a box.

4. The module according to claim 1, wherein the light sources are miniature, light emitting diodes.

5. The module according to claim 4, wherein each diode has an elongated bulb envelope inclined relative to the front and back walls.

6. The module according to claim 1, wherein there are three of said rows.

7. The module according to claim 1, wherein each support strip is a printed circuit board.

8. The module according to claim 1, wherein the reflector means is a generally planar, reflector panel overlying the back wall and having an irregular, light-reflecting, textured surface.

9. The module according to claim 1, and further comprising means on the housing for adhering the module in a predetermined position.

10. The module according to claim 4, wherein the energizing means includes main power supply means for converting AC voltage to DC voltage to energize the light emitting diodes.

11. The module according to claim 10, wherein the energizing means includes back-up power supply means for converting a low, back-up DC voltage to a higher DC voltage to energize the light emitting diodes.

* * * * *